US006884082B1

(12) United States Patent
James

(10) Patent No.: US 6,884,082 B1
(45) Date of Patent: Apr. 26, 2005

(54) SENSORY FEEDBACK EDUCATIONAL TOOL

(76) Inventor: Donna James, 2928 Sparrow Dr., York, PA (US) 17404

( * ) Notice: Subject to any disclaimer, the term of this patent is extended or adjusted under 35 U.S.C. 154(b) by 23 days.

(21) Appl. No.: 10/673,877

(22) Filed: Sep. 29, 2003

Related U.S. Application Data

(63) Continuation-in-part of application No. 10/121,797, filed on Apr. 15, 2002, now abandoned.

(51) Int. Cl.[7] ..... B43L 1/00
(52) U.S. Cl. ..... 434/408
(58) Field of Search ..... 434/81, 84, 85, 434/98, 408, 409, 413, 416, 418, 422, 425, 429

(56) References Cited

U.S. PATENT DOCUMENTS

| | | | | | |
|---|---|---|---|---|---|
| 61,254 | A | * | 1/1867 | Rhees | 434/415 |
| 181,653 | A | * | 8/1876 | DuBrul | 434/159 |
| 189,473 | A | * | 4/1877 | Kingsley | 434/417 |
| 723,340 | A | * | 3/1903 | Tompkins | 434/415 |
| 1,950,423 | A | * | 3/1934 | Wightman | 446/70 |
| 3,570,139 | A | * | 3/1971 | Ladd | 434/346 |
| 3,819,064 | A | | 6/1974 | Chandler | 214/1 C |
| 4,138,689 | A | | 2/1979 | Montalbano | 354/337 |
| 4,582,492 | A | * | 4/1986 | Etter et al. | 434/236 |
| 4,574,977 | A | | 3/1987 | Ellis et al. | 220/403 |
| 4,762,493 | A | * | 8/1988 | Anderson | 434/84 |
| 4,878,844 | A | * | 11/1989 | Gasper et al. | 434/159 |
| D331,396 | S | | 12/1992 | Benk et al. | D14/114 |
| 5,425,664 | A | * | 6/1995 | Coffey | 446/135 |
| 5,467,696 | A | | 11/1995 | Everhart | 99/425 |
| 5,636,743 | A | | 6/1997 | Dalbo | 206/564 |
| 5,690,051 | A | | 11/1997 | Fisher et al. | 119/166 |
| 5,769,639 | A | * | 6/1998 | Foster | 434/159 |
| 5,958,525 | A | * | 9/1999 | Green et al. | 428/14 |
| 6,024,571 | A | | 2/2000 | Renegar | 434/157 |
| 6,050,824 | A | * | 4/2000 | Stuart | 434/159 |
| 6,077,221 | A | | 6/2000 | Fowler, Jr. | 600/233 |

OTHER PUBLICATIONS

Rachel Paulsen, "Different Scents Help Body Physically, Emotionally" Royal Purple online, 2002<retrieved online Mar. 26, 2004>.*

Amazing Products Store, Jun. 2003 <retrieved online Mar. 26, 2004>.*

Essential Health, Jun. 2002 <retrieved online Mar. 26, 2004>.*

* cited by examiner

*Primary Examiner*—Kurt Fernstrom
(74) *Attorney, Agent, or Firm*—Hooker & Habib, P.C.

(57) ABSTRACT

An educational tool for teaching a child to read and write includes a writing board having a writing surface and a raised rim extending around the writing surface. A displaceable writing medium is held in the tool. Indicia, such as raised letters, are distributed along the rim. The tool includes scent-impregnated plastic. The indicia and scent provide additional sensory stimulus to the child that assists the child in learning.

14 Claims, 5 Drawing Sheets

SENSORY FEEDBACK EDUCATIONAL TOOL

This application is a continuation-in-part of my application Ser. No. 10/121,797 filed Apr. 15, 2002, now abandoned.

FIELD OF THE INVENTION

The invention relates to an educational tool for teaching reading and writing skills.

BACKGROUND OF THE INVENTION

A known educational tool for teaching reading and writing skills includes a flat writing surface and a raised rim that surrounds the surface. A displaceable writing medium, commonly table salt, is distributed over the writing surface. The student writes in the salt by pressing his or her finger against the surface and forming letters, numbers or shapes. Shaking redistributes the salt and erases the writing. The rim prevents the salt from spilling from the writing surface.

The tool assists young or physically challenged children in learning to read and write. Many such children lack the muscle coordination to hold chalk or pencils. The tool enables a child to write with just his or her finger, without use of chalk or pencils. The child receives visual and tactile feedback while writing in the salt, and many young children or challenged students find the tool fun and motivating to use.

SUMMARY OF THE INVENTION

The invention is an improved educational tool for teaching reading and writing skills. The invention provides additional sensory feedback to the student for more effective learning and memory retention, and is more convenient to use than conventional tools of its type.

An educational tool in accordance with the present invention includes a writing board having a writing surface. A raised rim extends around the writing surface, the rim and the writing surface defining the interior of the tool for holding a displaceable writing medium.

In a first embodiment indicia are disposed about the writing surface. The indicia provide additional sensory feedback to the child that assists the child in learning to read and write. In preferred forms of this embodiment the indicia includes letters, numerals or shapes that correspond to letters, numerals or shapes written or read by the child in the writing medium. The indicia provide additional visual feedback that enables the child to see correctly formed letters, numerals or shapes before, during and after writing in the writing medium.

The indicia can be located on the rim and/or on an outer periphery of the writing board. The indicia can be even with the rim or periphery surface. Preferably the indicia have raised surfaces, recessed surfaces, or both, that provide tactile feedback to a student running his or her fingers over the indicia and feeling the shape of the indicia by its edges.

In a second embodiment of the present invention the educational tool is used while exposing the student to a scent, preferably peppermint. Research has found that the scent of peppermint boosts mood and motivation, and improves concentration. Other scents could be used that enhance learning or mental acuity. The sense of smell provides additional sensory feedback that enhances learning.

In preferred forms of this second embodiment the scent is impregnated into the material forming the tool. The educational tool preferably includes scented plastic that carries the scent. This enables the student to be exposed to the scent whenever the tool is used.

Alternatively, the scent could be provided separately from the tool itself. For example, the scent could be applied to the student directly or on clothing or accessories worn by the student. Candy containing the scent could be enjoyed by the student while using the tool. Room deodorizers containing the scent could be used.

In yet a third embodiment of the present invention the tool includes a pour spout extending from the interior of the tool to outside the tool for convenient removal of writing medium. The pour spout provides for easy disposal of the writing medium, making the tool easier to use.

In preferred forms of this third embodiment the tool has a pour spout that is movable between opened and closed positions. In its opened position a shoot or opening is defined to flow writing medium. In its closed position the pour spout essentially "disappears", forming part of the rim and writing board. This enables the spout to be closed without a cap, plug, or other separate closure. With the pour spout closed, the tool can be stacked or stored like a conventional tool.

Educational tools in accordance with the present invention provide additional multi-sensory feedback to students learning to read or write. The increased feedback generated by sight, touch, movement and smell provides increased and varied stimulus to the brain to stimulate learning. Young children learn faster while challenged learners are better motivated and more likely to overcome physical challenges to succeed. The tools are easy to use, clean, and store, making them more likely to be used by teachers.

Other objects and features of the invention will become apparent as the description proceeds, especially when taken in conjunction with the accompanying five drawing sheets illustrating six embodiments of the invention.

DESCRIPTION OF THE PREFERRED EMBODIMENTS

Figure 1:
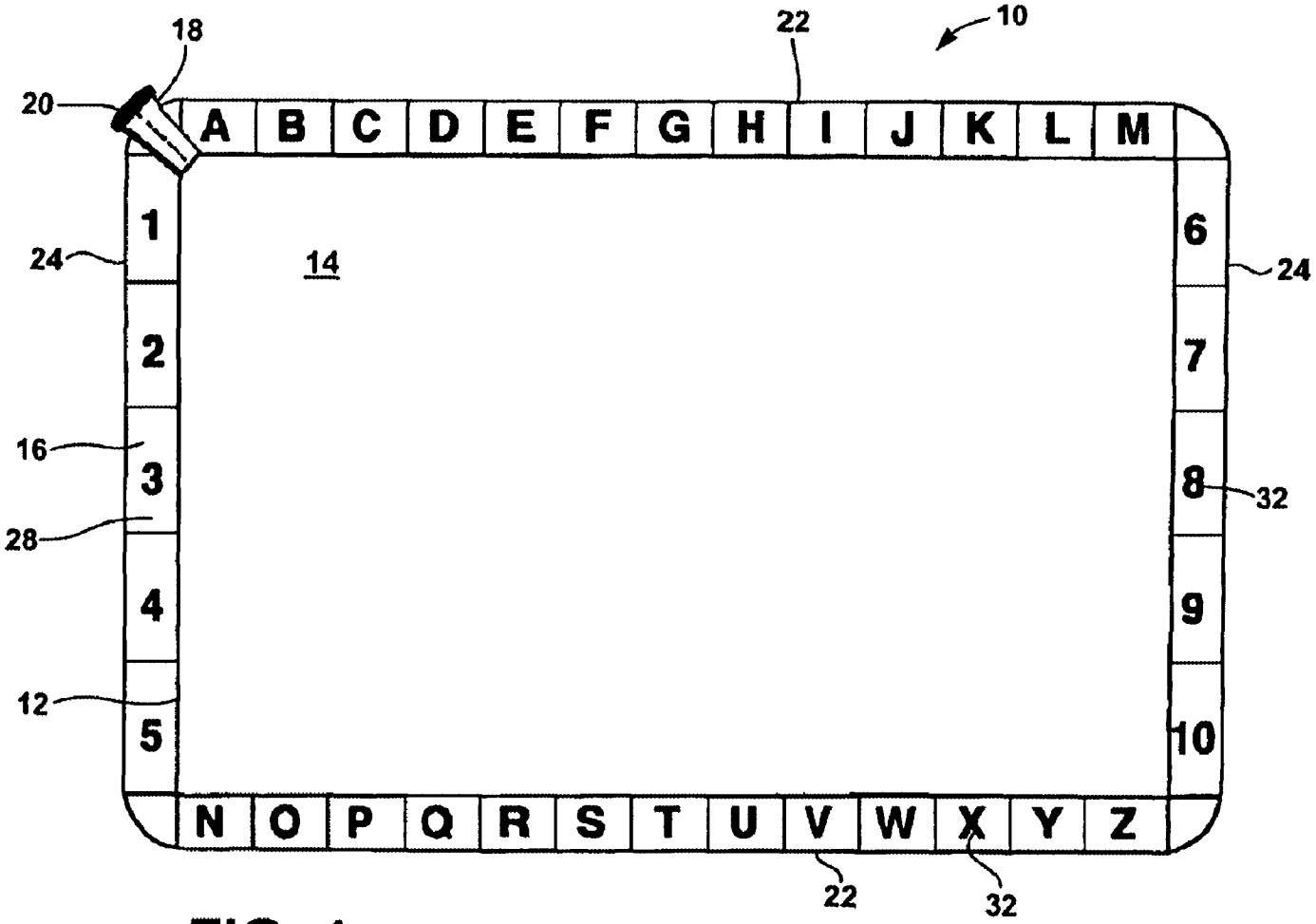
FIG. 1 is a top view of a first embodiment educational tool made in accordance with the present invention.
Figure 2:
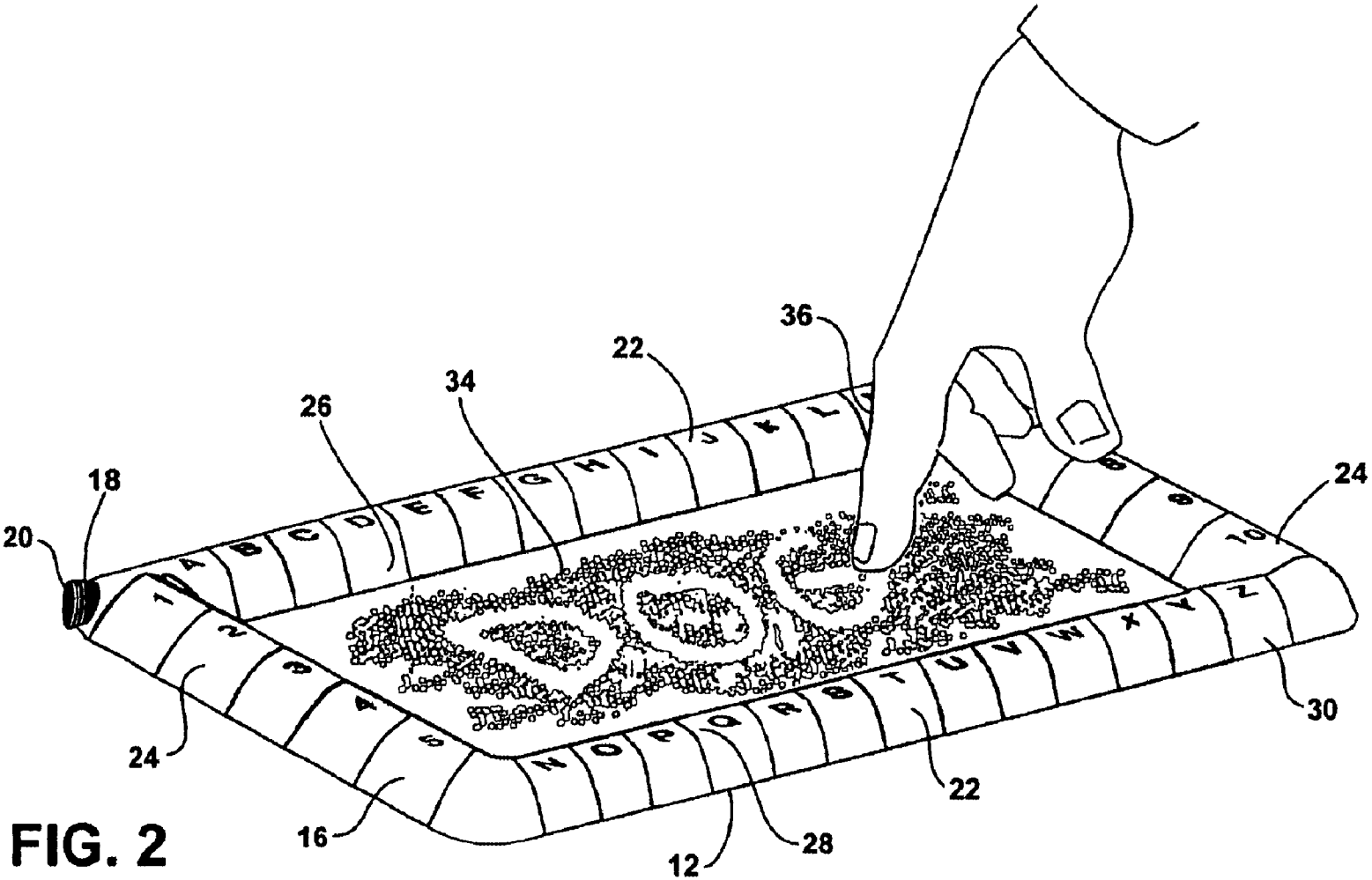
FIG. 2 is a perspective view of a child writing in the tool shown in FIG. 1.

FIGS. 1 and 2 illustrate a first embodiment educational tool 10 in accordance with the present invention. The educational tool 10 includes a writing board 12 that defines an upwardly facing, generally flat writing surface 14. A raised rim 16 extends upwardly from the writing board 12 around the outer perimeter of the writing surface. The rim and writing surface defines the interior of the tool 10.

A pour spout 18 extends from the interior of the tool, through the rim 16, to the outside of the tool. For clarity the portion of the rim above the spout is not shown in FIG. 1 so that the entire length of spout would be shown in the drawing. The spout includes a removable spout plug 20 that closes the outer end of the pour spout. The plug is preferably attached to or hinged to the outer end of the spout.

Rim 16 includes a pair of opposed longer sides 22 and a pair of opposed shorter sides 24. Each side has a similar convex cross section, with a generally vertical inner face 26, an upper face 28 facing away from the writing surface and an outer face 30.

Formed on the upper face 28 are a number of spaced apart indicia 32. The indicia 32 in the illustrated embodiment include letters of the alphabet extending along the longer sides of the rim and numerals extending along the shorter sides of the rim, the letters or numerals printed within contrasting color bands spaced along the rim. It should be understood that other indicia could be used as desired.

FIG. 2 illustrates use of the tool 10. A conventional displaceable writing medium 34, preferably table salt, is poured on the writing surface 14. Other suitable writing media include sand, rice, and viscous fluids such as cornstarch and water mixtures. The writing surface is preferably finished in a contrasting color from the writing medium so that writing formed in the medium is clearly visible against the surface. In the illustrated embodiment the surface 14 is colored black to provide high contrast against the white table salt.

The figure illustrates a child writing in the salt with his or her finger 36. The child writing with his or her arm directing the finger provides kinetic, or muscle motion, feedback to the child. The child's finger pressing against the surface 14 and displacing the salt 34 provides tactile feedback to the child while writing. The high-contrast, easily visible writing formed in the salt provides visual feedback to the child that accompanies the kinetic and tactile feedback.

In addition, the indicia 32 provide additional visual feedback that assists the child in learning to read and write. For example, as shown in FIG. 2, the child is writing the word DOG. The indicia 32 includes the letters D, O, G that enable the child to see the correct shape of the letters. The child can use the indicia 32 before, during and after writing in the tool 10 for assistance in learning to read and write with the tool 10.

After use, the plug 20 is removed from the spout 18 and the salt is poured out of the tool through the spout 18 for easy cleanup.

Figure 3:
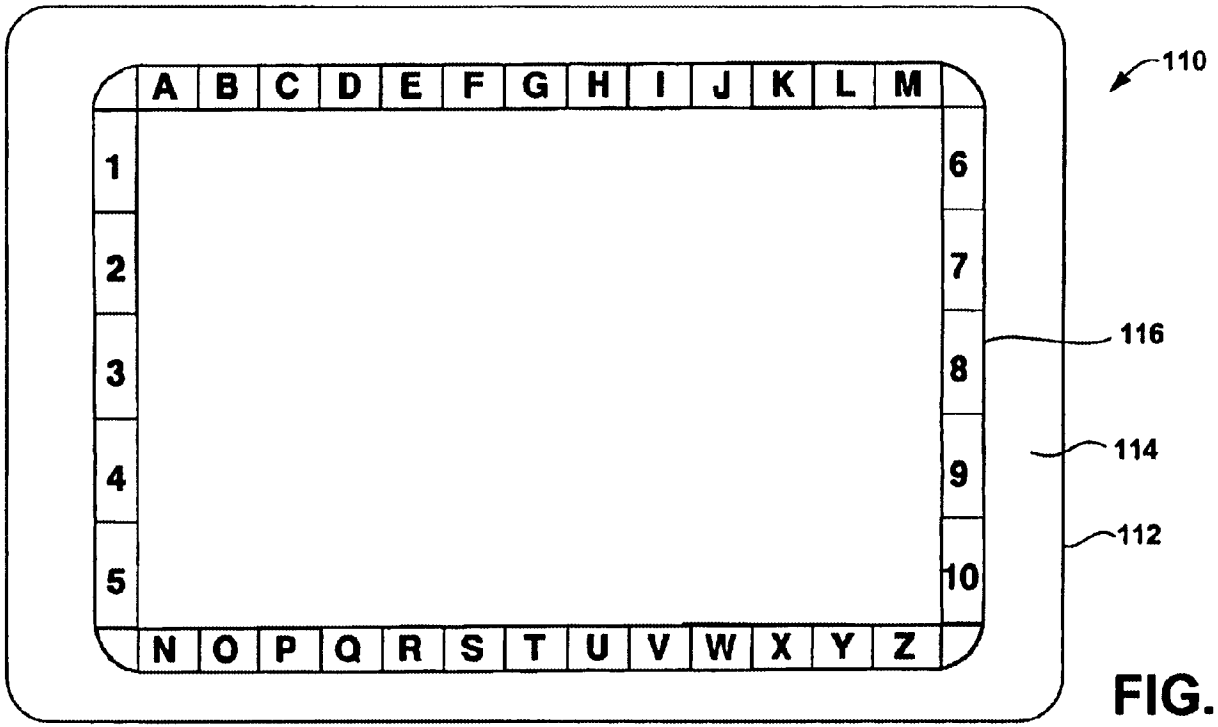
FIG. 3 is a top view of a second embodiment educational tool made in accordance with the present invention.
Figure 4:
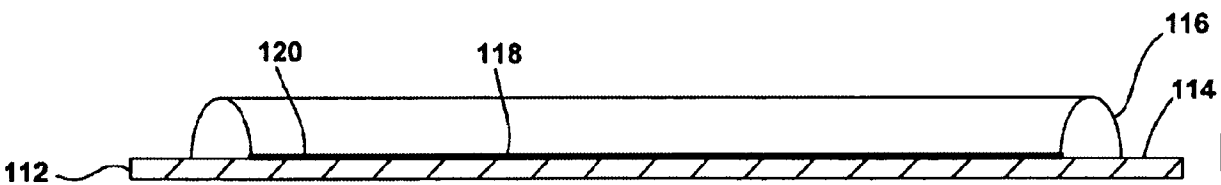
FIG. 4 is a sectional side view of the educational tool shown in FIG. 3.

FIGS. 3 and 4 illustrate a second embodiment educational tool 110 similar to educational tool 10. The writing board 112 includes an outer periphery 114 that extends beyond the rim 116. The extended outer periphery provides additional stability for the tool 110. In this embodiment the writing surface 118 includes a non-stick or low friction coating 120 that reduces finger drag when writing. The coating can be made from TEFLON (trademark) low friction material or functional equivalent.

Figure 5:
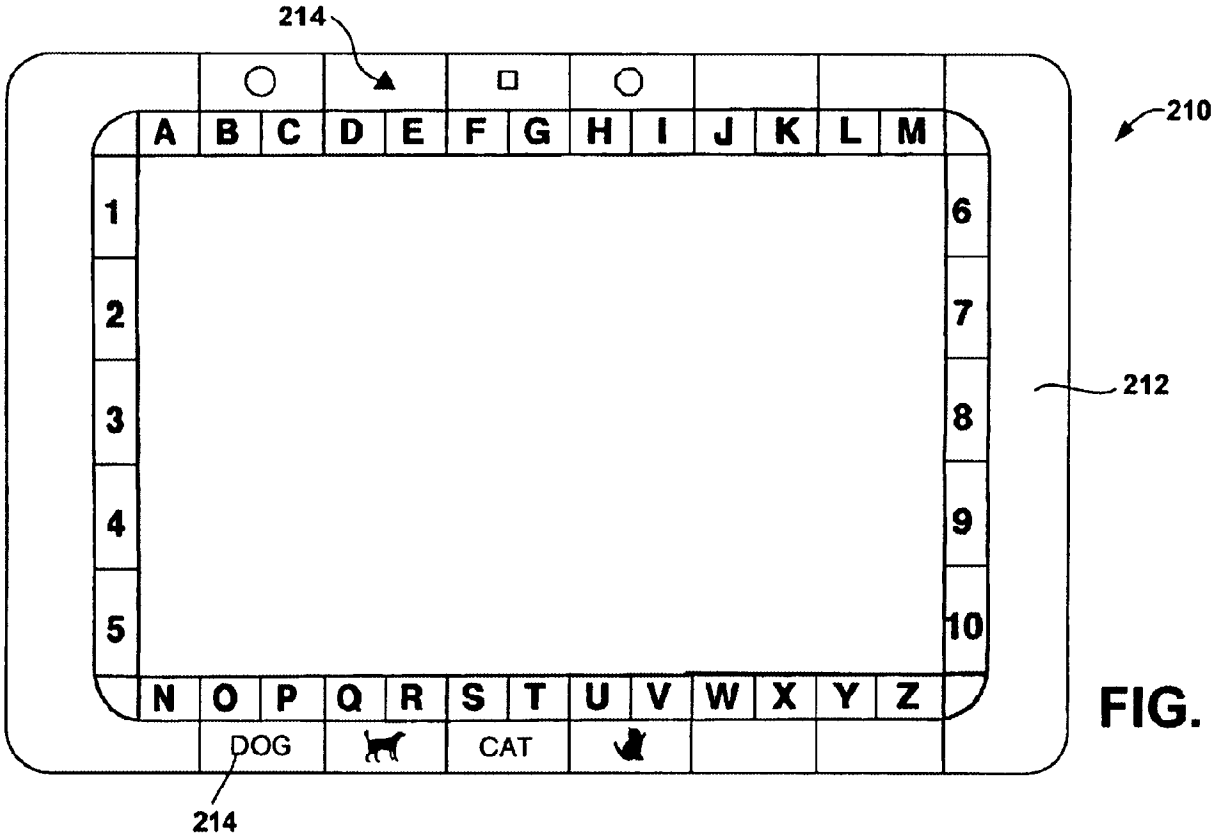
FIG. 5 is a top view of a third embodiment educational tool made in accordance with the present invention.

FIG. 5 illustrates a third embodiment educational tool 210 similar to educational tool 110. The upper surface of the outer periphery 212 includes additional indicia 214 (not all are shown in FIG. 5). The additional indicia 214 include simple spelled-out words, outlines or drawings of objects spelled out by the words, and common geometric shapes. For example, the indicia shown in FIG. 5 includes the word DOG and a representation of a dog that would be helpful to a child attempting to read or write the word DOG formed in the salt with the tool 210.

Figure 7:
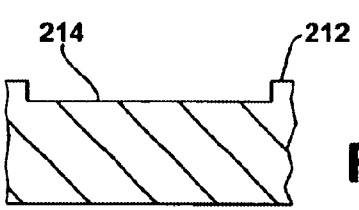
FIG. 7 is a partial side view of a portion of a fifth embodiment educational tool similar to the tool shown in FIG. 5 but including recessed indicia.

The indicia 214 can be formed substantially even with the upper surface of periphery 212. In alternative fourth and fifth embodiments shown in FIGS. 6 and 7, the indicia 214 can extend above or be proud of the surface (FIG. 6) or be recessed below the surface (FIG. 7). Such indicia can provide tactile feedback to a child running his or her fingers over the indicia and feeling the shape of the indicia by its edges.

Figure 8:
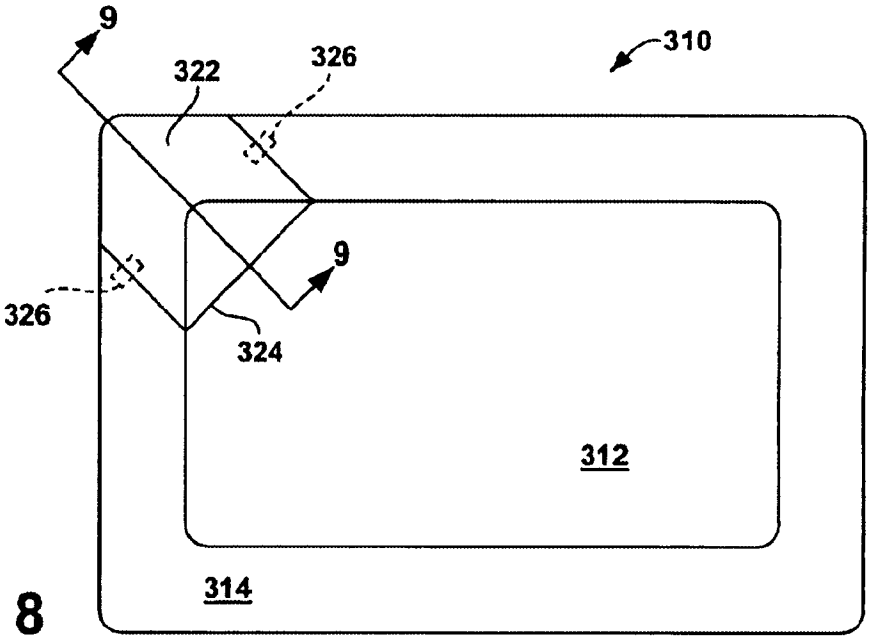
FIG. 8 is a top view of a sixth embodiment educational tool made in accordance with the present invention, the tool shown with its pour spout closed.

FIG. 8 illustrates a sixth embodiment educational tool 310. This tool 310 includes scented plastic as explained in further detail below. The plastic is preferably impregnated with peppermint scent in an amount sufficient to be sensible to the student during normal use of the tool. Education studies report that the scent of peppermint boosts the mood and motivation of a student and improves concentration.

Tool 310 includes a writing board 312 and a rim 314 formed from injection-molded plastic. A closeable pour spout 318 described in further detail below forms a portion of the rim and writing board. FIG. 8 shows the spout in its closed position.

Figure 6:
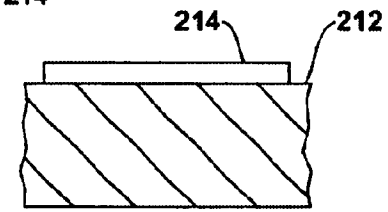
FIG. 6 is a partial side view of a portion of a fourth embodiment educational tool similar to the tool shown in FIG. 5 but including raised indicia.

The rim 314 includes raised indicia (not shown) similar to the indicia shown in FIG. 6. The rim is formed by "multi-molding" or "multicomponent molding" in which articles are molded from two or more different molding materials. Indicia is molded from scented plastic, preferably peppermint-scented plastic. The remainder of the rim is molded from unscented plastic. The scented plastic and unscented plastic preferably have contrasting colors.

The scented plastic has a scent that is sensible to the student using the tool. The scent motivates the student and increases concentration, thereby enhancing learning. The tool 310 provides sensory feedback generated by sight, touch, movement and smell.

Preferably the scent is impregnated in the tool itself as exemplified by the tool 310 so that the scent is available whenever the tool is used.

It is within the contemplation of the invention, however, that the scent could be delivered as a stimulus by other vectors. As non-limiting examples: a room deodorizer having the desired scent could be sprayed in the air prior or during a lesson; the scent could be applied to accessories worn by the student; or the scent could be incorporated in candies provided the student during a lesson. These illustrate some of the alternative methods of delivering scent as a learning aid or stimulus to the student while using the tool.

The board 312 and rim 314 are initially formed as a one-piece unit. An outer peripheral spout member 322 is formed by cutting along a cut line 324 to remove the spout member from the remainder of the tool. The spout member is pivotally re-mounted to the rim 314 by a pair of pivot pins 326.

Figure 9:
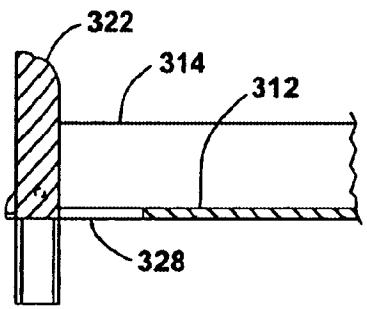
FIG. 9 is a partial sectional view of the tool shown in FIG. 8 taken generally along line 9—9 of FIG. 8 but with its pour spout open.

The spout member is pivotable between a closed position shown in FIG. 8 and an opened position shown in FIG. 9. When the spout member is in the closed position, the board and rim take substantially the shape of the original one-piece unit. The gap along the cut line 324 is preferably sized such that writing medium cannot flow through the gap when the spout member is in the closed position.

Pivoting the spout member 322 to the open position opens the spout and enables writing medium to drain from the tool through shoot discharge opening 328. The spout member forms a portion of the shoot that channels the discharge of writing medium from the tool.

Moving the spout member 322 back to its closed position closes the spout and essentially causes the spout to "disappear". The tool 310 can now be stacked or stored without the interference of a permanently extending pour spout. The spout can also be closed without the need of a separate plug or closing member.

In alternative embodiments the cut line can be formed having mutually facing surfaces or overlapping surfaces that engage each other to cooperatively close the gap when the spout is closed. Gaskets or seals could also be used to seal the gap if relatively small or low-viscosity writing media is used.

While I have illustrated and described a preferred embodiment of my invention, it is understood that this is capable of modification, and I therefore do not wish to be limited to the precise details set forth, but desire to avail myself of such changes and alterations as fall within the purview of the following claims.

What I claim as my invention is:

1. An educational tool for providing visual and tactile feedback to a student learning reading and writing skills comprising:

a writing board comprising a writing surface;

a raised rim extending around the writing surface, the rim and the writing surface defining the interior of the tool for holding a displaceable writing medium;

indicia disposed about the writing surface to provide additional sensory feedback to the student while using the tool; and a pour spout for flowing writing medium out of the interior of the tool, the pour spout communicating the interior of the tool with the exterior of the tool for flowing writing medium out of the tool.

2. An educational device for providing visual and tactile feedback to students learning reading and writing skills comprising:

a writing board comprising a writing surface;

a raised rim extending around the writing surface, the rim and the writing surface defining the interior of the device for holding a displaceable writing medium in the device; and a pour spout for flowing writing medium out of the interior of the device, the pour spout communicating the interior of the device with the exterior of the device.

3. The educational device of claim 2 wherein the pour spout extends through the rim.

4. The educational device of claim 2 wherein the pour spout includes a removable member for closing an end of the spout.

5. The educational device of claim 2 wherein the pour spout is pivotally mounted to the remainder of the device and is movable between an opened position wherein the spout is open and a closed position wherein the spout is closed.

6. The educational device of claim 2 wherein the spout comprises a movable member movable between an opened position wherein the spout is open and a closed position wherein the spout is closed; and the member forms a portion of the rim when the spout is in the closed position.

7. An educational tool for providing sensory feedback to a student learning reading and writing skills comprising:

a writing board comprising a writing surface;

a rim extending around the writing surface, the rim and the writing surface defining an open container for holding a displaceable writing medium; and a displaceable writing medium in the container on the writing surface, the writing medium directly touchable by the student for forming writing or drawing on the writing surface;

at least a portion of the rim comprising a scented material having a scent that is sensible to the student while using the tool, whereby the tool provides sensory feedback to the student generated by sight, touch, movement and smell.

8. The educational tool of claim 7 wherein the scented material comprises scented plastic.

9. The education tool of claim 8 wherein the rim comprises unscented plastic and said scented plastic.

10. The educational tool of claim 7 comprising indicia disposed about the writing surface to provide additional sensory feedback to the student while using the tool, the scented material forming the indicia.

11. The educational tool of claim 7 wherein the scented material forms at least a portion of the rim.

12. The educational tool of claim 7 wherein the scented material has a peppermint scent.

13. The education tool of claim 12 wherein the scented material comprises plastic impregnated with the peppermint scent.

14. The educational tool of claim 7 wherein the scented material extends at least partially around the writing surface.

* * * * *